US007934887B2

(12) United States Patent
Thomas et al.

(10) Patent No.: US 7,934,887 B2
(45) Date of Patent: May 3, 2011

(54) COMPLEMENTARY LOCKING SYSTEM FOR LOCKING LEGS TO THE DECK OF AN OFFSHORE DRILLING PLATFORM AND METHODS FOR INSTALLING ONE SUCH LOCKING SYSTEM

(75) Inventors: Pierre-Armand Thomas, Puteaux (FR); Christian Perol, Viroflay (FR); Marc Cahay, Villemomble (FR)

(73) Assignee: Technip France (FR)

( * ) Notice: Subject to any disclaimer, the term of this patent is extended or adjusted under 35 U.S.C. 154(b) by 667 days.

(21) Appl. No.: 11/815,380

(22) PCT Filed: Feb. 1, 2006

(86) PCT No.: PCT/FR2006/000224

§ 371 (c)(1),
(2), (4) Date: Apr. 18, 2008

(87) PCT Pub. No.: WO2006/082312

PCT Pub. Date: Aug. 10, 2006

(65) Prior Publication Data

US 2008/0279637 A1 Nov. 13, 2008

(30) Foreign Application Priority Data

Feb. 4, 2005 (FR) ..... 05 01157
Sep. 9, 2005 (FR) ..... 05 09230

(51) Int. Cl.
*E02B 17/08* (2006.01)

(52) U.S. Cl. ..... 405/198; 405/196; 405/203; 405/208

(58) Field of Classification Search ..... 405/196, 405/197, 198, 199, 201, 202, 203, 204, 208, 405/221; 403/375; 248/218.4, 227.3
See application file for complete search history.

(56) References Cited

U.S. PATENT DOCUMENTS

| | | | | |
|---|---|---|---|---|
| 4,269,543 | A * | 5/1981 | Goldman et al. | 405/198 |
| 4,589,799 | A * | 5/1986 | Hotta et al. | 405/196 |
| 4,662,787 | A * | 5/1987 | Tatsuguchi | 405/198 |
| 5,188,484 | A * | 2/1993 | White | 405/198 |
| 5,833,396 | A * | 11/1998 | Thomas | 405/198 |
| 5,915,882 | A * | 6/1999 | Darwiche et al. | 405/198 |
| 6,076,996 | A * | 6/2000 | Choate et al. | 405/198 |
| 6,231,269 | B1 * | 5/2001 | Shear et al. | 405/198 |
| 2002/0182014 | A1 | 12/2002 | Kawasaki | 405/196 |
| 2006/0056920 | A1 * | 3/2006 | Foo et al. | 405/196 |

OTHER PUBLICATIONS

PCT International Search Report and Written Opinion dated Apr. 18, 2006 issued in corresponding PCT International Application No. PCT/FR2006/000224.

* cited by examiner

*Primary Examiner* — David J Bagnell
*Assistant Examiner* — Benjamin Fiorello
(74) *Attorney, Agent, or Firm* — Ostrolenk Faber LLP

(57) ABSTRACT

A complementary locking system for locking legs to the deck of a jack-up offshore drilling platform is disabled. The system includes at each leg, at least one assembly comprising plates forming two counter-racks that engage with a leg rack and, on one side of the plates, at least one internal element for connecting the internal edges of the plates, at least one external element for connecting the external edges of the plates and at least one intermediate member for connecting said at least one internal element to said at least one external element. Methods of installing said complementary locking system on the legs of a jack-up offshore drilling platform are also disclosed.

32 Claims, 12 Drawing Sheets

COMPLEMENTARY LOCKING SYSTEM FOR LOCKING LEGS TO THE DECK OF AN OFFSHORE DRILLING PLATFORM AND METHODS FOR INSTALLING ONE SUCH LOCKING SYSTEM

CROSS REFERENCE TO RELATED APPLICATION

The present application is a 35 U.S.C. §§371 national phase conversion of PCT/FR2006/000224, filed Feb. 1, 2006, which claims priority of French Application No. 0501157, filed Feb. 4, 2005 and French Application No. 0509230, filed Sep. 9, 2005. The PCT International Application was published in the French language.

BACKGROUND OF THE INVENTION

The present invention relates to a complementary locking system for locking legs to the deck of a jack-up offshore drilling platform, as well as methods for installing one such locking system on the legs of an offshore drilling platform.

Offshore drilling platforms, of the jack-up type, for example oil platforms, generally include legs, substantially three in number, supported on the seabed, together with a fitted deck that can be displaced and adjusted in height along the legs and substantially carrying production equipment and living quarters.

After its construction, the platform assembly is generally floated to the drilling or production site, and the legs are lowered into contact with the seabed, then supported on the legs, the deck is hoisted above sea level up to a height that puts it outside the range of the highest waves.

The deck can thus be displaced along the deck's support legs by means of drive mechanisms housed inside a bearing framework supported by the deck and well-known to specialists as a "jack-house".

Said drive mechanisms of each support leg each comprise at least two opposing geared motor assemblies driving output pinions that cooperate with opposing racks fitted on the legs.

For this, each leg passes through the deck and the bearing framework of said drive mechanisms and is formed of superimposed sections assembled together by welding. Each section generally consists of vertical chords, three or four in number, interconnected by a lattice of metal girders or by caissons.

Each chord is formed, on the one hand, by a rectangular plate and, on the other, by stiffeners each having the form of a half-shell, each welded onto one of the main faces of said plate.

Each rectangular plate comprises teeth on its lateral faces, which form diametrically opposing racks, intended to cooperate with the output pinions of the drive mechanisms.

Throughout the production run, the platform deck is maintained in its operating position out of the water by the drive mechanisms and more particularly by the pinions of said mechanisms, which engage with the teeth of the support leg racks.

Now the deck, due to its structure and due to the fact that it supports all the equipment, represents a load of several thousand metric tons exerted on the various drive mechanisms.

In addition, the legs, which are solidly anchored onto the seabed, are subject to various marine currents which have the effect of producing shear forces on the leg chords. Said forces obviously have repercussions on the various pinions, in addition to the weight of the platform deck.

SUMMARY OF THE INVENTION

The purpose of the invention is to provide a complementary locking system for locking legs to the deck of an offshore drilling platform for simply and significantly reducing the load exerted on the drive mechanism pinions of the legs of said platform in its operating position out of the water.

The subject of the invention is therefore a complementary locking system for locking legs to the deck of a jack-up offshore drilling platform, the deck bearing drive mechanisms including, for each leg, at least two groups of opposing pinions, cooperating with the opposing racks and fitted onto the legs for displacing the deck between a floating position and an operating position out of the water and for maintaining this deck on the legs in this operating position, characterized in that it includes, on each leg, at least one assembly comprising two opposing counter-racks, each formed of a plate equipped with teeth intended to be engaged with a rack, and on the same side of the plates, at least one internal element for connecting the internal edges of the counter-rack plates and at least one external element for connecting the external edges of the counter-rack plates.

According to other characteristics of the invention:

- the system includes means of parting the two counter-rack plates from one another at the time of installing the assembly on the racks of the corresponding leg,
- the system includes means of parting the two counter-rack plates from one another at the time of installing the assembly on the racks of the corresponding leg and of bringing said two counter-rack plates together after the installation of the assembly,
- the system includes means of bringing the two counter-rack plates together after the installation of the assembly on the racks of the corresponding leg,
- the system includes means of maintaining the two counter-rack plates in a clamped position after the installation of the assembly, and each counter-rack plate is borne by a support plate and at least one counter-rack plate is movable on its support plate via at least one means of displacement between an open mounting position of the assembly on the racks of the corresponding leg and a closed locking position of the counter-rack plates on the racks of said leg after the installation of the assembly.

The object of the invention is a method of installing a locking system, characterized in that it consists of the following steps:

- placing at the level of the deck and close to each leg, at least one assembly formed of two counter-racks and internal and external connecting elements,
- parting the two counter-racks from one another,
- fitting the two counter-racks onto the racks of the corresponding leg,
- allowing the counter-racks to take up their initial position so as to maintain the assembly on the corresponding leg, and
- wedging each assembly on the platform deck.

The object of the invention is also a method of installing a locking system, characterized in that it consists of the following steps:

- placing at the level of the deck and close to each leg, at least one assembly formed of two counter-racks and internal and external connecting elements,
- parting the two counter-racks from one another, fitting the counter-racks onto the racks of the corresponding leg, bringing said two counter-racks together onto the racks, maintaining the counter-racks in this clamping position, and wedging each assembly on the platform deck.

The object of the invention is equally a method of installing a locking system, characterized in that it consists of the following steps:

placing at the level of the deck and close to each leg, at least one assembly formed of two counter-racks and internal and external connecting elements, fitting the counter-racks onto the racks of the corresponding leg, clamping the two counter-racks onto the racks, maintaining the counter-racks in this clamping position, and wedging each assembly on the platform deck.

The object of the invention is also a method of installing a locking system, characterized in that it consists of the following steps:

placing at the level of the deck and close to each leg, at least one assembly, said at least movable counter-rack plate being in the open position, fitting the two counter-rack plates onto the racks of the corresponding leg, rotationally driving the cam of said at least means of displacement to bring the corresponding movable counter-rack plate into the closed locking position and to clamp the two counter-rack plates onto the racks, locking the ring on the movable counter-rack plate, and wedging each assembly on the platform deck.

The object of the invention is finally a method of installing a locking system, characterized in that it consists of:

placing at the level of the deck close to each leg, at least one assembly, said at least movable counter-rack plate is in the open position, fitting the two counter-rack plates onto the racks of the corresponding leg, rotationally driving the cams of the main means of displacement for clamping the two counter-rack plates onto the racks, rotationally driving the cams of the secondary means of displacement for completing the clamping of the two counter-rack plates onto the racks, locking the rings on the movable counter-rack plate, and wedging each assembly on the platform deck.

BRIEF DESCRIPTION OF THE DRAWINGS

The invention will be better understood on reading the description that follows, given by way of example and referring to the attached drawings, in which.

DESCRIPTION OF PREFERRED EMBODIMENTS

Figure 1:
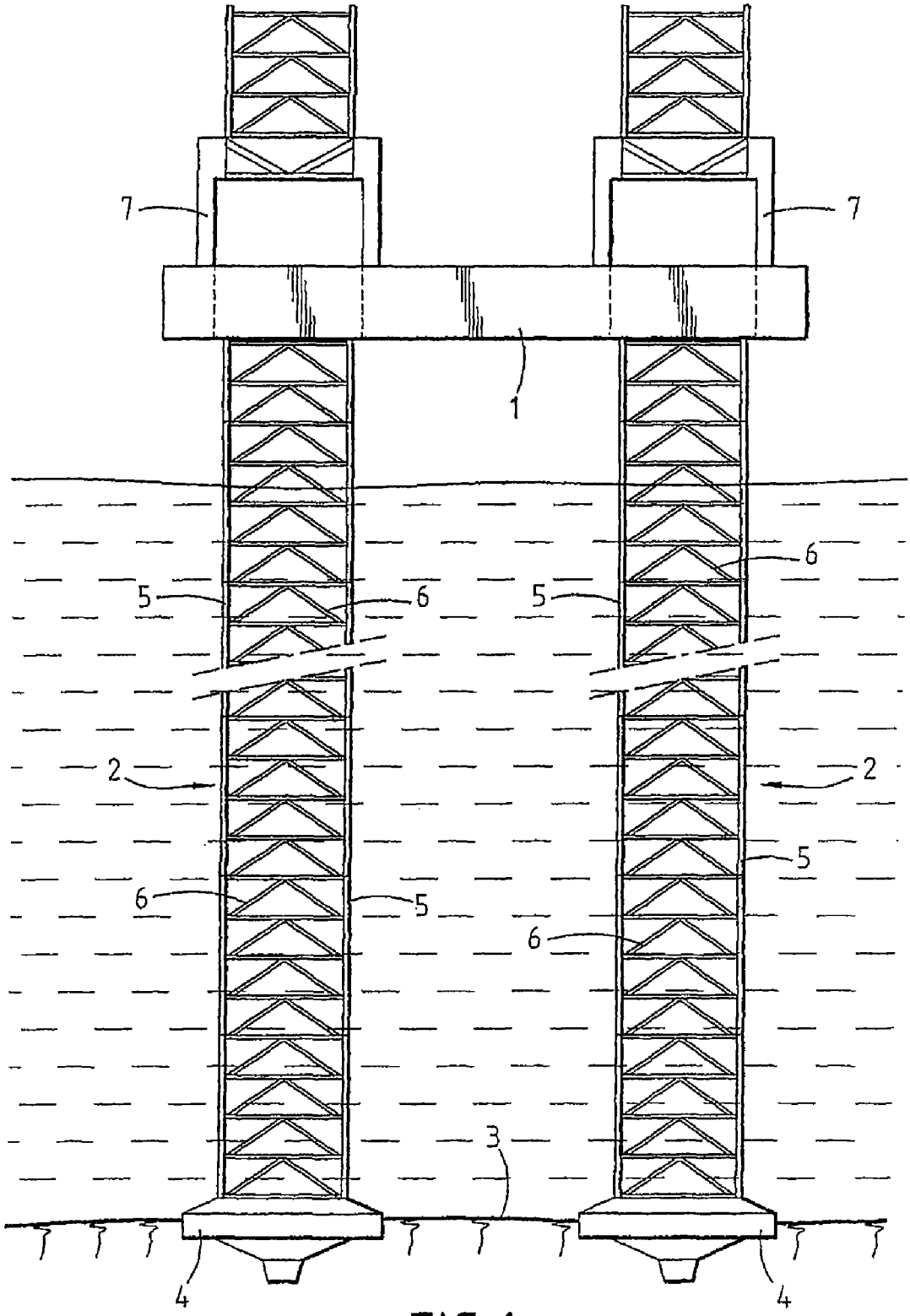
FIG. 1 is a diagrammatic elevation view of an offshore drilling platform in the floating position.

FIG. 1 is a diagrammatic representation of a substantially jack-up, offshore drilling platform, including a deck 1 provided conventionally with the usual production equipment and living quarters.

The deck 1 is displaceably fitted onto vertical legs 2 which are each for example triangular in section. These legs 2 may also be square or circular in section. They can be three or four in number, distributed uniformly on the deck 1.

Said deck 1 is fitted displaceably onto the vertical legs 2 intended for being supported on the seabed 3 through the intermediary of a base 4 when the platform is in a drilling or operating position.

In the usual way, each leg 2 is formed of three parallel chords 5 interconnected by a lattice of metal girders 6 or by caissons.

Figure 2:
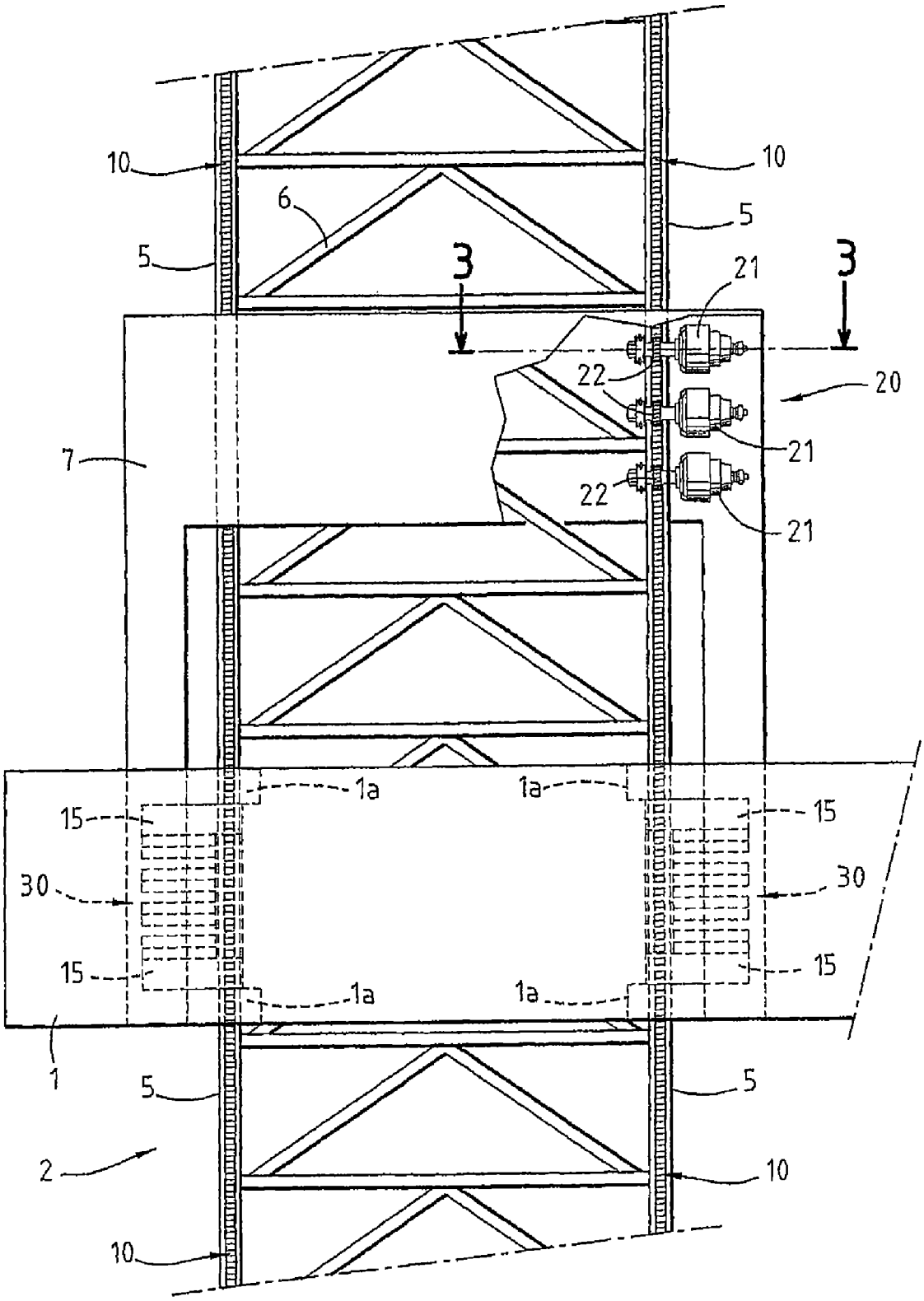
FIG. 2 is a larger scale, partially cut-away, diagrammatic view of one of the platform legs showing a part of the drive mechanisms and a complementary locking system for locking legs to the deck, according to the invention.

The deck 1 is displaced on the legs 2 by means of drive mechanisms designated as a whole by the reference 20, housed for each leg 2, in a bearing framework 7 also called a "jack-house" by specialists. At the level of each leg 2, each bearing framework 7 is supported by the deck 1, as shown in FIGS. 1 and 2.

Figure 3:
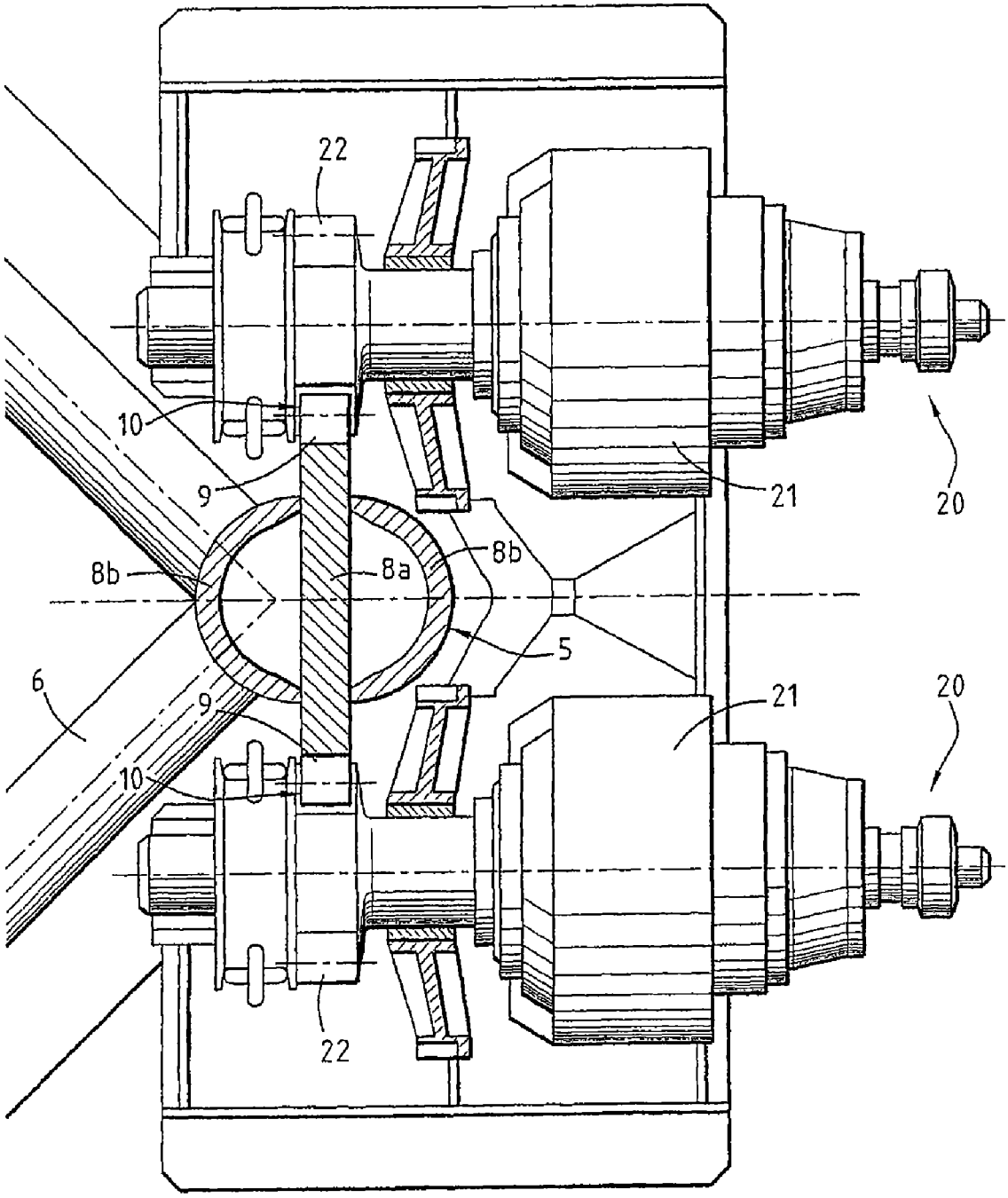
FIG. 3 is a sectional view along the line 3-3 in FIG. 2.

As depicted in FIG. 3, at least two chords 5 of each leg 2 are each formed, on the one hand, by a rectangular plate 8*a* and, on the other, by stiffeners 8*b* each having the form of a half-shell and which are welded onto one of the main faces of said plate 8*a*. Each rectangular plate comprises teeth on its lateral faces 9, which form diametrically opposing racks 10. Each drive mechanism 20 for the displacement of the deck 1 on the legs 2 is conventionally formed of geared motor assemblies 21 each driving an output pinion 22 engaging with the teeth 9 of a rack 10 of the chord 5 of a corresponding leg 2.

In the usual way, the platform is brought to the drilling or production site by floating the deck 1 and the legs 2 are lowered into contact with the seabed 3. Supported on the legs 2, the deck 1 is hoisted through the intermediary of the pinions 22 each rotationally driven by a corresponding geared motor 21 of the drive mechanisms 20, which engage with the teeth 9 of a rack 10.

The deck 1 of the platform is thus raised to the desired height for operation.

In order to reduce the load exerted on the pinions 22 of the drive mechanisms 20, each leg 2 is equipped, at the level of the deck 1, with a complementary locking system for locking said legs 2 to the deck 1.

Referring now to FIGS. 4 to 12, several modes of embodiment of a complementary locking system assembly will be described.

In general, the complementary locking system is composed of at least an assembly designated by the general reference 30, which comprises two opposing counter-racks 31 each formed of a plate 32 generally rectangular in shape.

The plates 32 allow a space 33 between them for positioning the assembly 30 on the racks 10 of a chord 5 of a leg 2, as will be seen later.

The opposite edges of the two plates 32 are provided with a series of teeth 34 complementary in form to the teeth 9 of the racks 10.

The assembly 30 also comprises, on the same side of the plates 32, at least one internal element 40 for connecting the internal edges 32*a* of the plates 32 and at least one external element 45 for connecting the external edges 32*b* of said plates 32.

In preference, the internal element 40 is formed of several parallel stiffeners 41, uniformly distributed over the length of the plates 32 allowing an interval 42 between them. Each stiffener 41 of the internal connecting element 40 has the form of a half-ellipse.

The external connecting element 45 is also formed of several parallel stiffeners 46, uniformly distributed over the length of the plates 32 allowing an interval 47 between them. The stiffeners 46 of the external element 45 are preferably located at the same level as the stiffeners 41 of the internal element 40.

In the examples of embodiment shown in FIGS. 4 to 10, each stiffener 46 of the external connecting element 45 includes a straight central portion 46*a* extending parallel to the plates 32 and two lateral portions 46*b* each connecting one end of the straight portion 46*a* to an external edge 32*b* of a plate 32.

Finally, the assembly 30 comprises at least one intermediate member for connecting the internal element 40 with the external element 46.

In the examples of embodiment depicted in FIGS. 4 to 10, said at least intermediate connecting member is formed, at the level of each assembly of stiffeners 41 and 46, of two spacers 50 extending between a stiffener 41 and a curved portion 46*b* of a stiffener 46.

Figure 4:
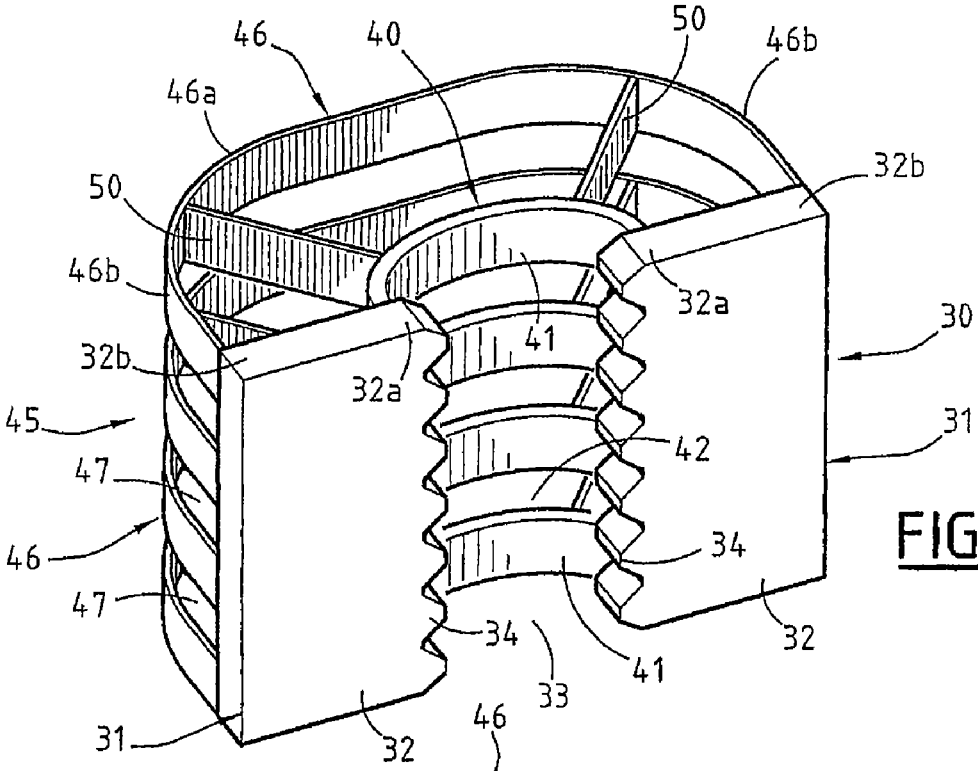
FIG. 4 is a diagrammatic perspective view of a first mode of embodiment of an assembly of the complementary locking system, according to the invention.

The installation of an assembly 30 according to the mode of embodiment depicted in FIGS. 4 to 6 on the racks 10 of a chord 5 of a leg 2 is carried out in the following way.

First of all, an assembly 30 is placed at the level of the deck 1 and close to the chord 5, arranging the plate 8*a* of the chord 5 opposite the space 33 left between the plates 32 of the counter-racks 31. Then, the two counter-racks 31 are parted from one another so as to increase the width of the interval 33, as shown in FIG. 5.

For this, the system is equipped with means for parting the two plates 32 from one another, which, for this mode of embodiment, consists of at least one source of heating, not shown, applied to at least the stiffeners 41 of the internal element 40. In order to facilitate the parting of the counter-racks 31, the heating source may be applied simultaneously to the stiffeners 41 of the internal element 40 and to the stiffeners 46 of the external element 45. This heating source consists, for example, of a welding torch or electrical heating elements or any other appropriate sources. The form of the stiffeners 41 and 46 is determined for facilitating the parting of the counter-racks 31 from one another during the heating phase whose temperature is of the order of 120° C. In FIG. 5, the deformation of the assembly 30 by heating has been deliberately exaggerated in order to make for better understanding. For example, the increase in width of the space 33 between the teeth 34 of the plates 32 is of the order of 2 to 6 mm. The spacers 50 prevent possible buckling of the assembly 30 when the counter-racks 31 are parted.

Figure 5:
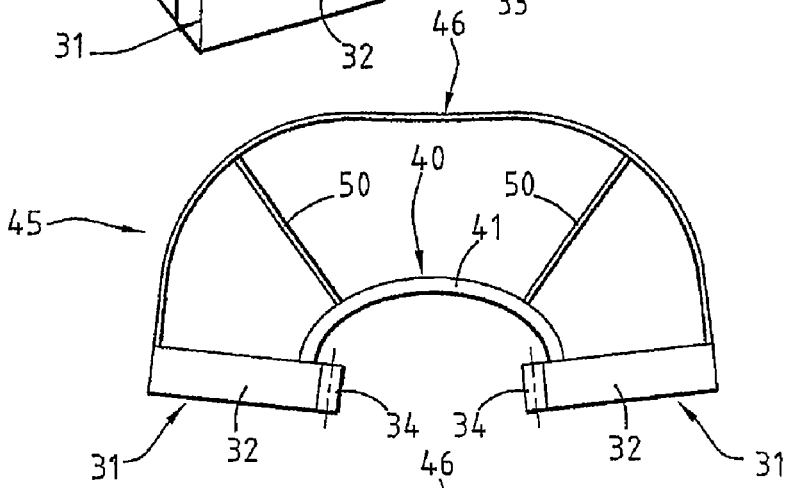
FIGS. 5 and 6 are diagrammatic top views of the assembly in FIG. 4 showing the steps of installing this assembly onto a platform leg.
Figure 6:
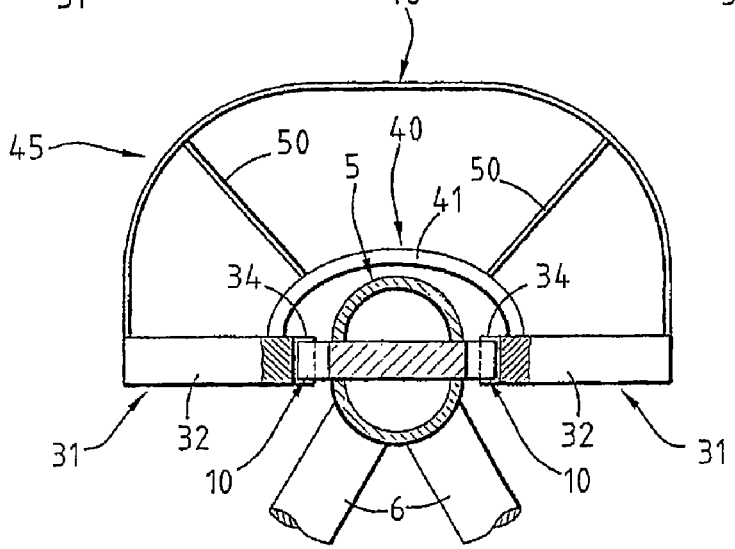

As soon as said counter-racks 31 are sufficiently parted, as shown in FIG. 5, the assembly 30 is displaced to bring the teeth 34 of said counter-racks 31 into the teeth 9 of the rack 10 of the chord 5.

Then, the assembly 30 is left to cool so thoroughly that the width of the space 33 between the teeth 34 of the counter-racks 31 is reduced and said teeth 34 engage onto the teeth 9 of the racks 10 thus bringing about the locking of the assembly 30 onto the corresponding chord 5.

As shown in FIG. 2, at least one assembly 30 is fitted onto the rack 10 of each chord 3 and each assembly 30 is wedged, for example, by means of wedges 15 which are arranged between the assembly 30 and an element 1*a* of the deck 1 structure so as to lock each assembly 30 with said deck 1.

The assemblies 30 thus installed on each chord 5 equipped with racks 10 of each leg 2 of the platform therefore enable the load exerted on the pinions 22 of the drive mechanisms 20 to be significantly reduced.

Figure 7:
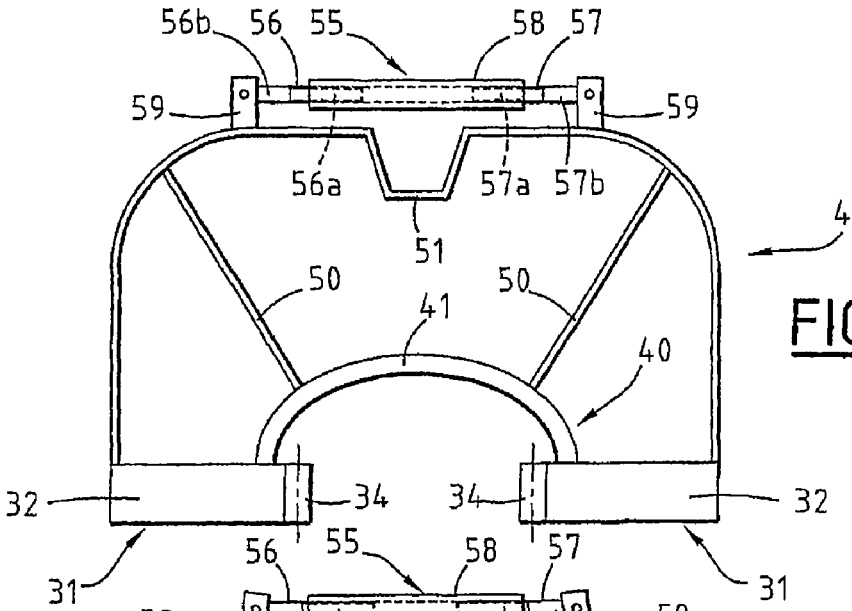
FIG. 7 is a diagrammatic top view of a second mode of embodiment of an assembly of the complementary locking system, according to the invention.
Figure 8:
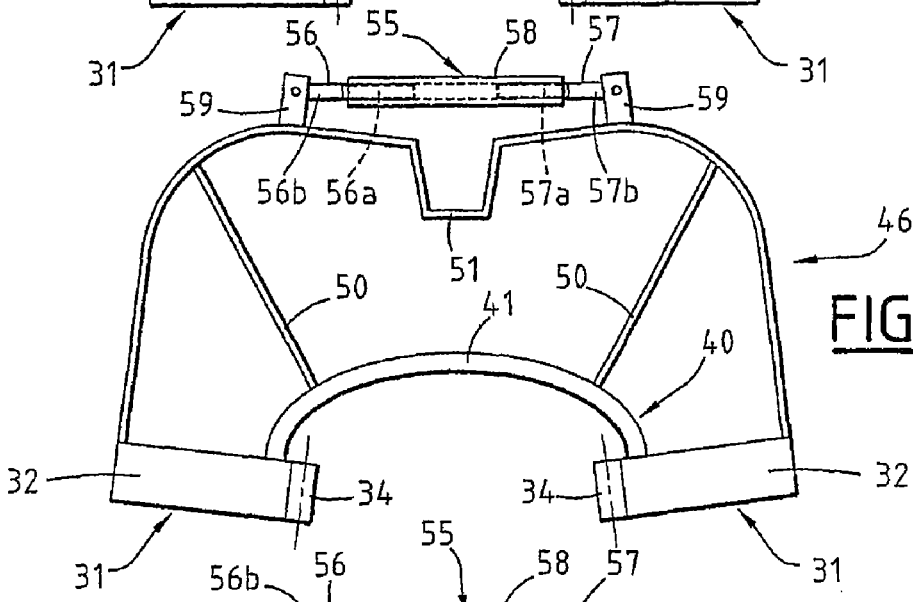
FIGS. 8 and 9 are diagrammatic top views of the assembly in FIG. 7 showing the steps of installing this assembly onto a platform leg.
Figure 9:
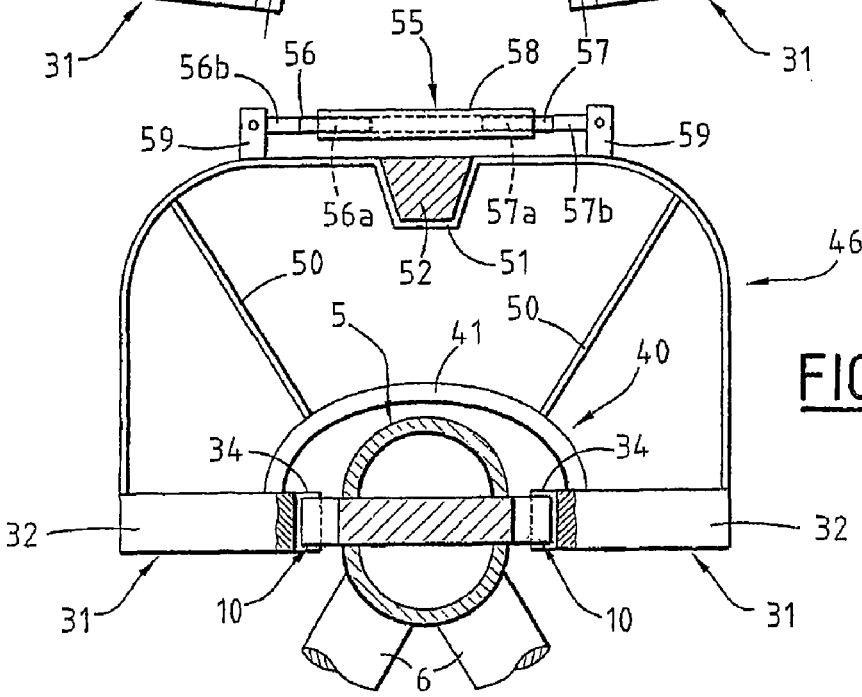

According to a second mode of embodiment depicted in FIGS. 7 to 9, the system includes means of parting the two plates 32 of the counter-racks 31 from one another at the time of installing the assembly 30 on the racks 10 of a chord 5 of a corresponding leg 2 and of bringing together said two plates 32 after the installation of said assembly 30.

In this mode of embodiment, the parts common to the previous mode of embodiment have been designated by the same references and the form of the stiffeners 41 and 46 is identical.

In this mode of embodiment, each stiffener 46 of the external element 45 substantially comprises in the middle of the straight portion 46*a*, a free space 51 directed towards the internal element 40. Said free space has, for example, the form of a wedge and is intended to receive means of maintaining the plates 32 in the clamped position.

In this mode of embodiment, the system includes means of parting the two plates 32 of the counter-racks 31 from one another at the time of installing the assembly 30 on the racks 10 of a chord 5 of the corresponding leg 2 and of bringing together said two plates 32 after the installation of said assembly 30.

Said means are formed of at least one mechanical device designated as a whole by the reference 55. Several mechanical devices 55 may also be provided.

The mechanical device 55 is composed of a first threaded rod 56 of which one end 56*a* is screwed into a threaded sleeve 58 and of which a second end 56*b* is hinge-mounted onto a base plate 59 fixed, for example by welding, onto the stiffeners 46. The mechanical device 55 also includes a second threaded rod 57 of which a first end 57*a* is screwed into the threaded sleeve 58 and of which a second end 57*b* is hinge-mounted onto a base plate 59 fixed, for example by welding, onto the stiffeners 46.

The sleeve 55 and the threaded rods 56 and 57 extend parallel to the plates 32 of the counter-racks 31.

The assembly 30 as depicted in FIGS. 7 to 9 is fitted onto a rack 10 of a chord 5 of a leg 2 in the following way.

First of all, at least one assembly 30 is placed at the level of the deck 1 and close to a chord 5 of a leg 2. Then, the sleeve 58 is rotated in a determined direction to cause the screwing of the threaded rods 56 and 57 into the sleeve 58 which, via the intermediary of the stiffeners 46 becoming deformed, causes an increase in the width of the space 33 left between the teeth 34 of the counter-racks 31, as shown in FIG. 8. In said figure, the deformation of the assembly 30 has been exaggerated in order to make for better understanding.

The two counter-racks 31 are fitted onto the racks 10 of the chord 5 in such a way that the teeth 34 of said counter-racks engage with the teeth 9 of the racks 10. The sleeve 58 is rotated in the reverse direction thus causing the translation of the threaded rods 56 and 57 in the opposite direction, i.e. in a direction causing a reduction in the width of the space 33 and, accordingly, clamping of the counter-racks 31 onto the racks 10 of the chord 5.

To maintain the assembly 30 in this clamping position, at least one wedge-shaped wedge 52 is inserted into the housing 51 arranged in the stiffeners 46, as shown in FIG. 9. After fitting, the wedge 52 can be welded onto the edges of the housing 51.

Other mechanical devices 55 may be provided for parting the counter-racks 31, for example one or more hydraulic or pneumatic jacks or any other appropriate system.

Figure 10:
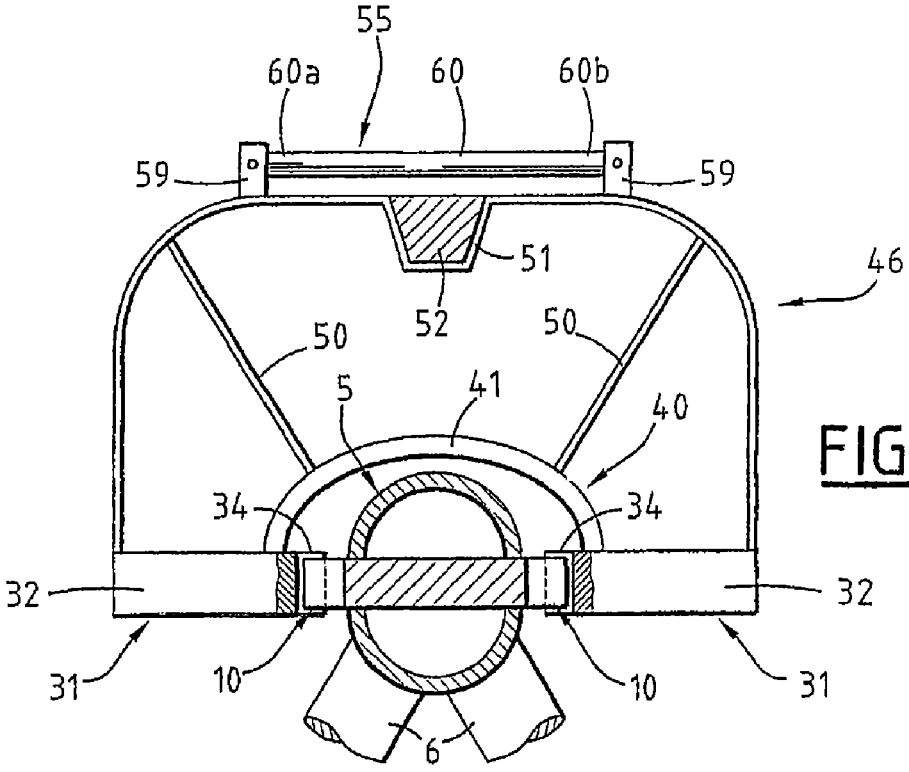
FIG. 10 is a diagrammatic top view of a third mode of embodiment of an assembly of the complementary locking system, according to the invention.

Furthermore, the mechanical device 55 may be composed, as depicted in FIG. 10, of at least one metal rod 60 including a first end 60*a* hinged on a base plate 59 fixed, for example by welding, onto the stiffeners 46, and a second end 60*b* hinged on a base plate 59 fixed, for example by welding, onto the stiffeners 46.

In this mode of embodiment, the initial parting between the teeth 34 of the counter-racks 31 is designed to be able to place the assembly 30 on the teeth 9 of the racks 10 without having to part said counter-racks 31 from one another, as in the preceding modes of embodiment.

Thus, after the assembly 30 has been placed on the racks 10 of a chord 5, the metal rod 60 is heated by appropriate means which, by expansion of said rod 60, causes the counter-racks 31 to be brought together and said counter-racks 31 to be clamped onto the racks 10 of the chord 5. The assembly 30 is maintained in this clamping position by the insertion of at least one wedge-shaped wedge 52 into the housing 51 arranged in the stiffeners 46, as shown in FIG. 10. After fitting, the wedge 52 can be welded onto the edges of the housing 51.

Figure 11:
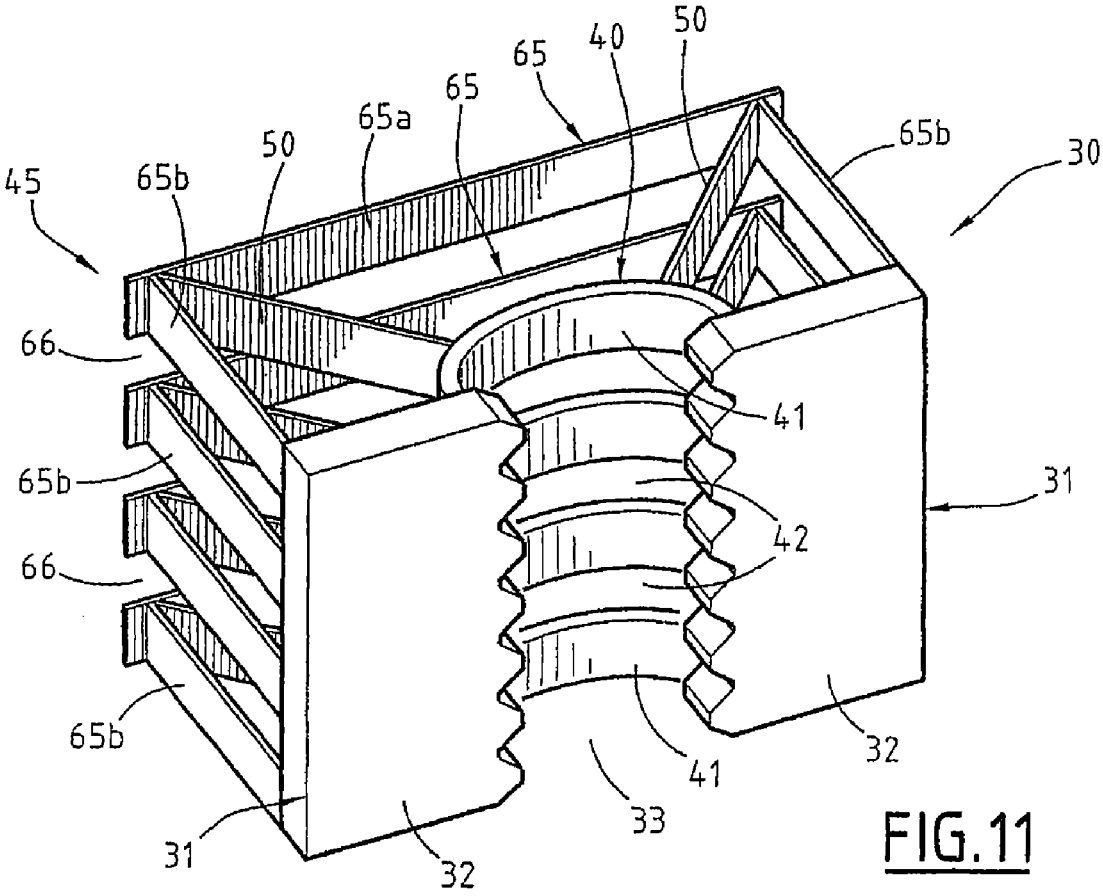
FIG. 11 is a diagrammatic perspective view of a fourth mode of embodiment of an assembly of the complementary locking system, according to the invention.

FIG. 11 depicts another mode of embodiment of the assembly 30 which differs from the other modes of embodiment chiefly in the form of the external element 45 for connecting the counter-racks 31.

In this mode of embodiment, the parts common to the previous modes of embodiment have been designated by the same references.

In this case, the external connecting element 45 is also composed of stiffeners 65 allowing an interval 66 between them.

Each stiffener 65 of the external connecting element 45 is formed of a straight central portion 65*a* extending parallel to the plates 32 of the counter-racks 31 and two lateral portions 65*b* each connecting one end of the central portion 65*a* to an external edge 32*b* of a plate 32.

Each spacer 50 extends between a stiffener 41 of the internal connecting element 40 and the corner formed between the straight portions 65*a* and 65*b*.

In this case also, the form of the stiffeners 41 and 65 contributes to exerting a parting force of the counter-racks 31 with respect to one another during the heating of at least the stiffeners 41 of the internal connecting element 40.

The mechanical devices for parting the counter-racks 31 may also be fitted on the stiffeners 65 in this mode of embodiment.

Figure 12:
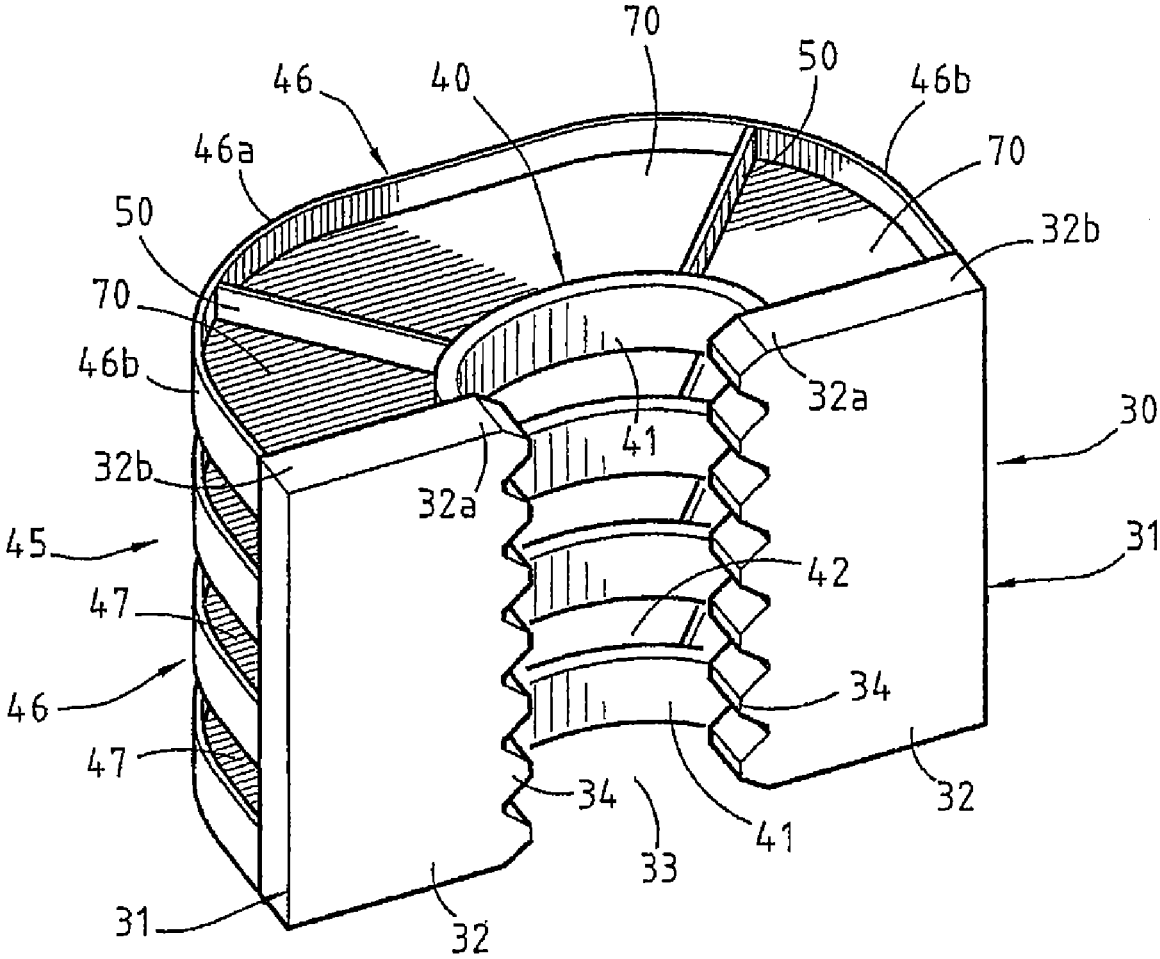
FIG. 12 is a diagrammatic perspective view of a fifth mode of embodiment of an assembly of the complementary locking system, according to the invention.

According to a fifth mode of embodiment depicted in FIG. 12, the assembly 30 comprises, between each pair of stiffeners 41 and 46 and each spacer 50, an intermediate plate 70 extending perpendicularly to said stiffeners 41 and 46 and said spacers 50.

Said horizontal plates 70 contribute to the diffusion of heat towards the stiffeners 46 of the external element 45 during heating of the stiffeners 41 of the internal element 40.

Moreover, in addition to the stiffeners 41 and 46, said horizontal plates 70 enable the hold of the assembly 30 onto the racks 10 to be improved. This is because the weight of the platform deck 1 creates what is termed by specialists a cogging thrust, which has a tendency to part the counter-racks 31 from the racks 10. This phenomenon is limited by the horizontal plates 70.

The assembly 30 of each mode of embodiment previously disclosed, may each be associated with the aforementioned means of parting and may or may not be equipped with horizontal plates 70. The stiffeners 46 may or may not be provided with a housing 51 for the positioning of at least one wedge 52 and may be formed of a central portion 46*a* and two curved portions 46*b* or only of straight portions 65*a* and 65*b*.

The various parts making up the assembly 30 are interconnected for example by welding or by any other appropriate means.

Without going outside the scope of the invention, several assemblies 30 may be fitted one above the other onto a rack 10 of a chord 5 of a leg 2.

In all cases, the assembly or assemblies 30 are, after fitting onto a rack 10, wedged with respect to the deck 1 in such a way that the assemblies 30 partly support the deck 1 so as to relieve the pinions 22 of the drive mechanisms 20.

Referring now to FIGS. 13 to 17, several variants of a complementary locking system assembly will be described.

In general, the complementary locking system is composed of at least an assembly designated by the general reference 30, which comprises two opposing plates 31 each forming a counter-rack and being generally rectangular in shape.

The counter-rack 31 plates allow a space 33 between them for positioning the assembly 30 on the racks 10 of a chord 5 of a leg 2, as will be seen later. The opposite edges of the two counter-rack 31 plates are provided with a series of teeth 34 complementary in form to the teeth 9 of the racks 10.

Each counter-rack 31 plate is borne by at least one support plate designated by the general reference 35.

Figure 13:
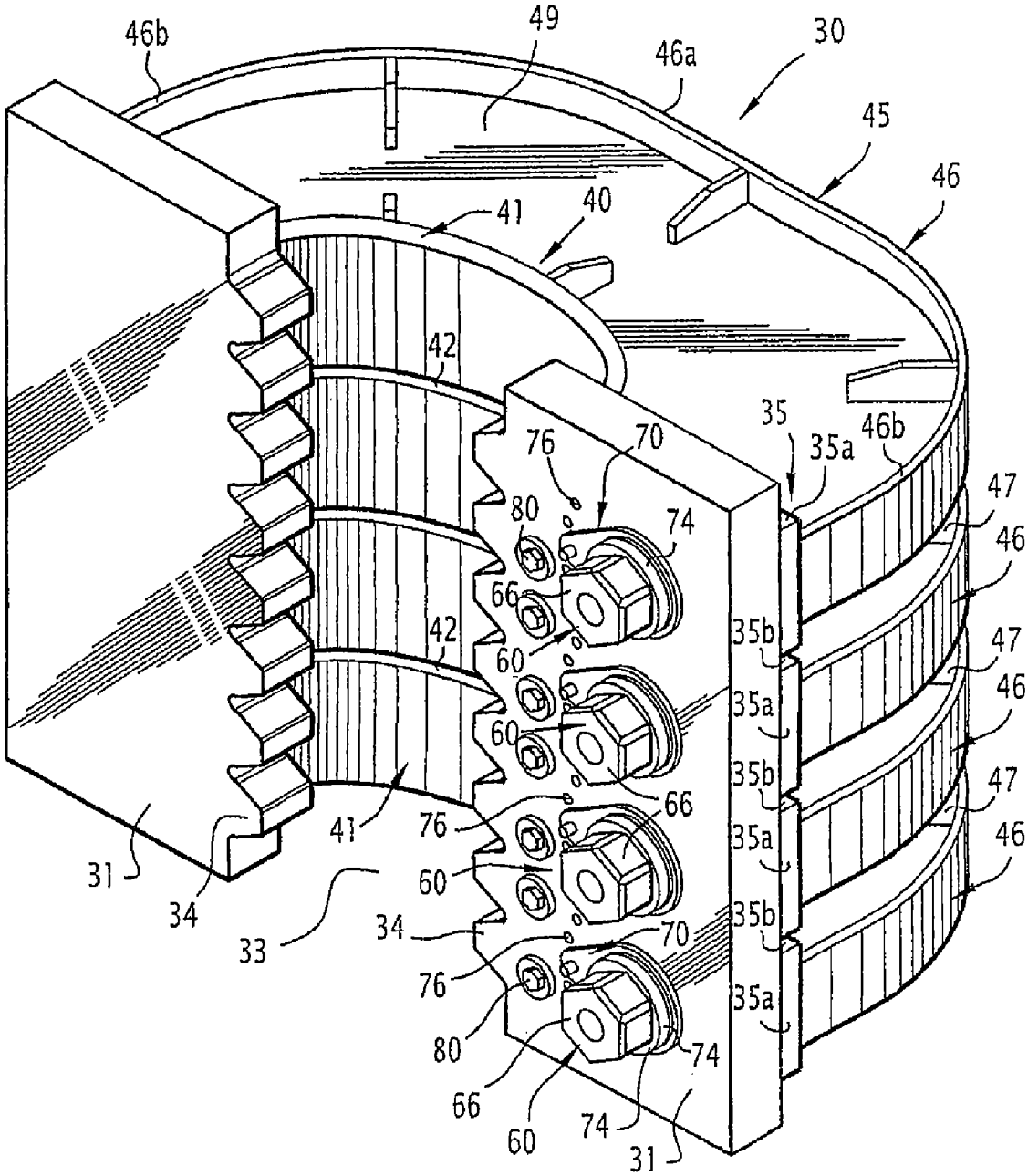
FIG. 13 is a diagrammatic perspective view of another mode of embodiment of an assembly of the complementary locking system, according to the invention.
Figure 14:
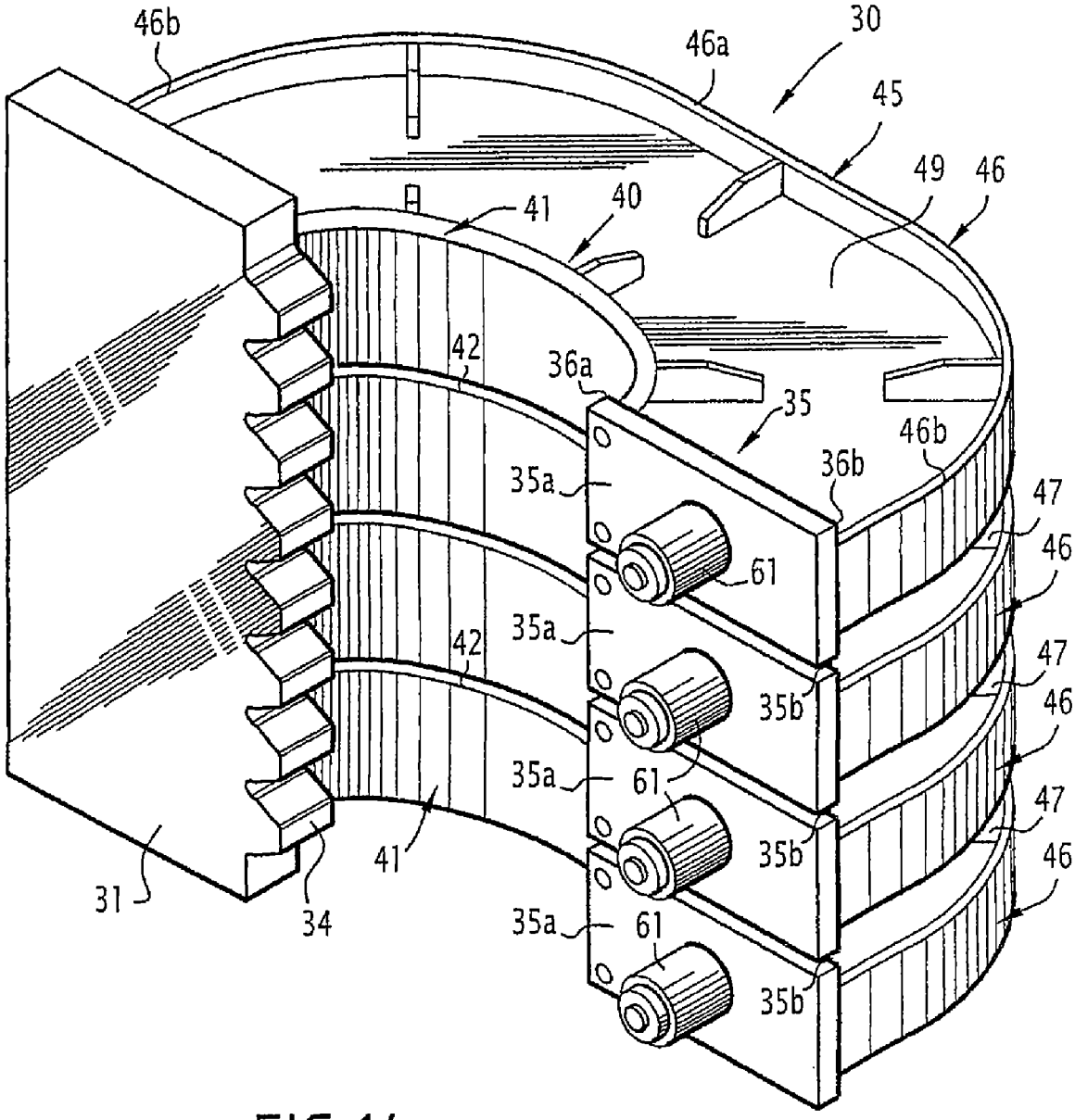
FIG. 14 is a diagrammatic perspective view of the assembly of the complementary locking system in FIG. 13 with a movable counter-rack plate removed.

In the example of embodiment depicted in FIGS. 13 and 14, each support plate 35 is constituted of several independent support sub-plates 35*a*, allowing an interval 35*b* between them. In this example of embodiment, each support plate 35 is formed of four support sub-plates 35*a*, the number of support sub-plates 35*a* being able to be more or less.

The assembly 30 also comprises, on the same side of the support plates 35, at least one internal element 40 for connecting the internal edges 36*a* of the plates 35 and at least one external element 45 for connecting the external edges 36*b* of said plates 35.

In preference, the internal element 40 is formed of several parallel stiffeners 41, distributed over the length of the counter-rack 31 plates allowing an interval 42 between them. Each stiffener 41 of the internal connecting element 40 has a curvilinear form, e.g. the form of a half-ellipse.

The external connecting element 45 is also formed of several parallel stiffeners 46, distributed over the length of the counter-rack 31 plates allowing an interval 47 between them. The stiffeners 46 of the external element 45 are preferably located at the same level as the stiffeners 41 of the internal element 40.

Figure 15:
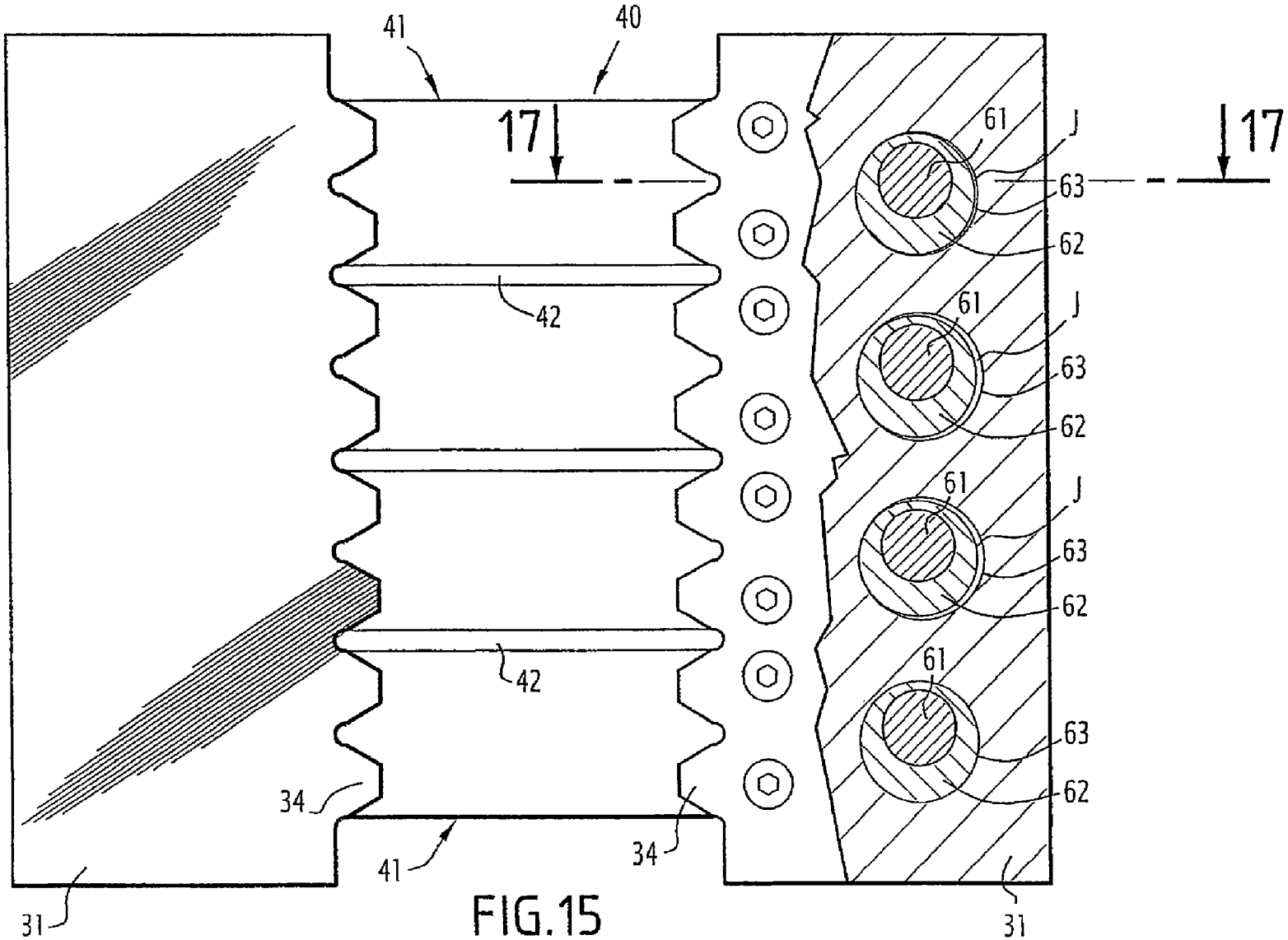
FIG. 15 is a diagrammatic elevation view of an assembly of the complementary locking system in vertical section along the line 15-15 in FIG. 16.

In the example of embodiment depicted in FIGS. 13 to 15, each support sub-plate 35*a* of the support plate 35 is associated with a pair of stiffeners 41 and 46 respectively.

Each stiffener 46 of the external element 45 includes a central portion 46*a* that may be straight and two lateral portions 46*b* extending a portion 46*a* up to an external edge 36*b* of a support sub-plate 35*a* of a support plate 35.

The assembly 30 also comprises at least one intermediate member for connecting the internal element 40 with the external element 45 and which, in the example of embodiment depicted in FIGS. 13 to 16, consists, between each pair of stiffeners 41 and 46, of an intermediate plate 49 extending perpendicularly to said stiffeners 41 and 46.

According to the invention, at least one counter-rack 31 plate is movable on its corresponding support plate 35 by at least one means of displacement 60 between an open position for installing the assembly 30 onto the racks 10 of the leg 2 and a closed position for locking the counter-rack 31 plates onto the racks 10 of said leg 2 after the installation of said assembly 30.

Referring now to FIGS. 13 to 16, a means of displacement 60 of the movable counter-rack 31 plate will be described. In the case where the assembly 30 comprises several means of displacement, each means of displacement 60 is identical to that described below.

Each means of displacement 60 includes a cylindrical pin 61 extending perpendicularly to the corresponding support plate 35 on its face opposite that equipped with stiffeners 41 and 46, and a cam 62 fitted on said pin 61. The cam 62 is arranged in an orifice 63 left in the movable counter-rack 31 plate.

Figure 16:
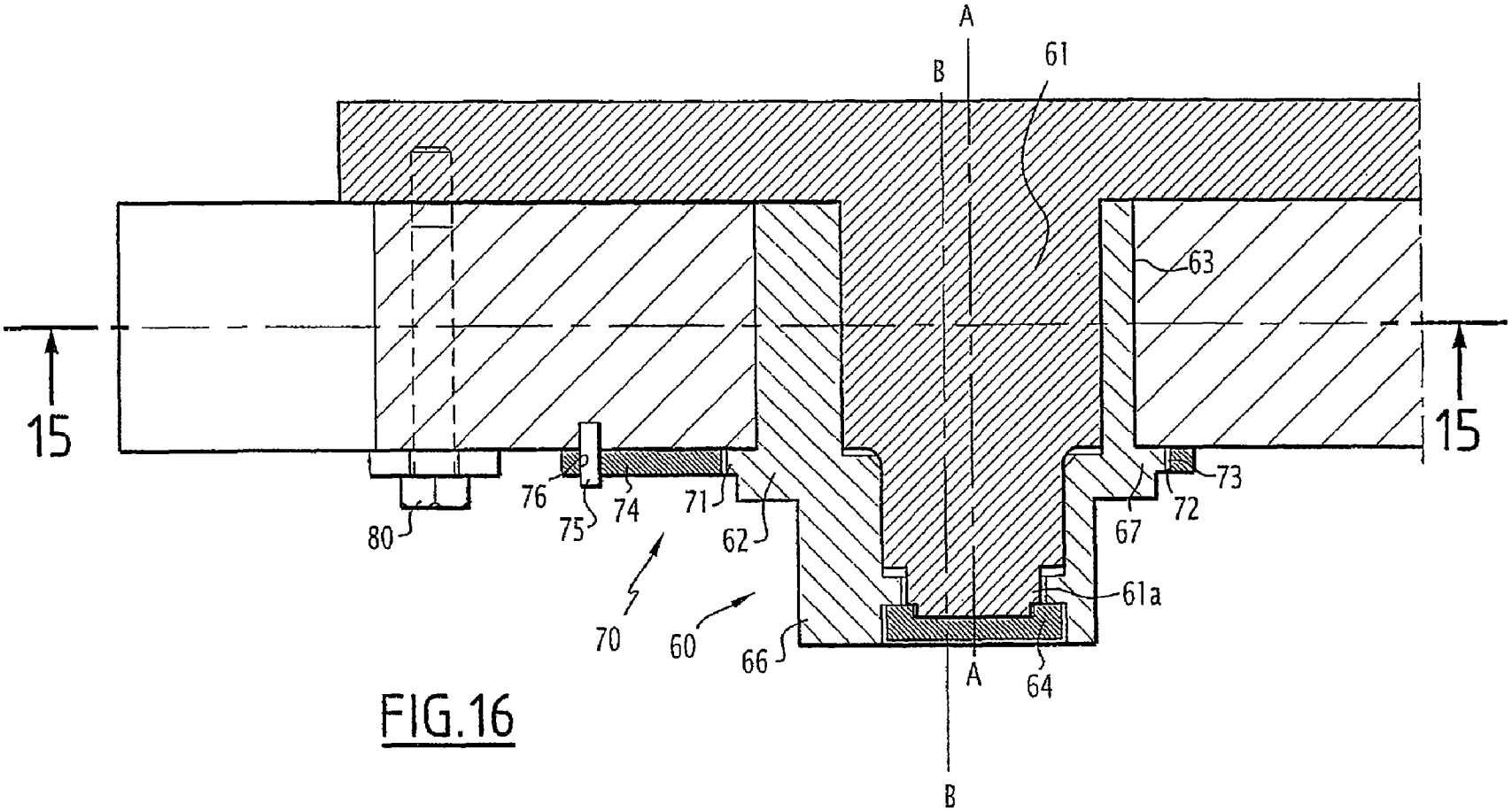
FIG. 16 is a diagrammatic cross-sectional view along the line 17-17 in FIG. 15, and FIGS. 17A and 17B are diagrammatic sectional views showing the position of a cam of a means of displacement, in an open position and in a closed position respectively, of the movable counter-rack plate.

As shown in FIG. 16, the axis B-B of the cam 62 is offset in relation to the axis A-A of the pin 61.

In the example of embodiment depicted in the figures and more particularly in FIG. 15, a clearance J is allowed between the external surface of the cam 62 and the internal surface of the orifice 63 for the means of displacement 60 located above the lowest means of displacement 60. In preference, the clearance J is greater on the cams 62 of the means of displacement 60 located between the lowest and the highest means of displacement 60 respectively for enabling the angular displacement of the movable counter-rack 31 plate, as will be seen later.

On the other hand, no clearance J other than the functional clearance is allowed between the cam 62 and the orifice 63 of the means of displacement 60 situated the lowest on the movable counter-rack 31 plate.

Other distributions of the clearance J between the cam 62 and the orifice 63 of the various means of displacement 60 may be envisaged according to the displacement of the movable counter-rack 31 plate that is wanted for its clamping.

In general, some means of displacement 60 have a greater clearance J than others.

The means of displacement 60 not having any clearance, other than the functional clearance, and called main means of displacement, are driven first while the means of displacement 60 having a predetermined clearance in addition to the functional clearance and called secondary means of displacement are driven after said main means of displacement so as to obtain a lateral displacement of the movable counter-rack 31 plate during the clamping of said main means of displacement.

As shown in FIG. 16, the cam 62 of each means of displacement 60 is locked in translation by a cap 64 screwed onto the free end 61*a* of the pin 61 which comprises a thread onto which said cap 64 is screwed.

In addition, the cam 62 of each means of displacement 60 comprises one end 66 jutting out with respect to the counter-rack 31 plate and intended to cooperate with a member for rotationally driving said cam 62.

By way of example and as shown in FIG. 13, the end 66 of each cam 62 is formed of a hexagonal head intended to cooperate with the member for rotationally driving said cam 62 formed for example of a hydraulic key of known type or by any other means having a complementary socket element at the end 66.

Finally, the cam 62 of each drive means 60 is provided with a shoulder 67 resting on the movable counter-rack 31 plate so as to maintain said counter-rack 31 plate on the support sub-plates 35*a* of the corresponding support plate 35.

The assembly 30 includes at least one means of locking the movable counter-rack 31 plate on its support plate 35 in the closed position for locking the counter-rack 31 plates onto the racks 10 of the corresponding leg 2.

The assembly 30 comprises as many means of locking the movable counter-rack 31 plate as means of displacement 60 of this movable counter-rack 31 plate.

As is apparent from FIG. 16, each means of locking designated by the general reference 70 is composed of a first cog 71 arranged on the periphery of the shoulder 67 of the cam 62. This first cog 71 is intended to cooperate with a second cog 72 arranged in an orifice 73 of a displaceable ring 74, thanks to the cogs 71 and 72 respectively, in rotation during the rotation of the cam 62. This ring 74 has for example an oblong form.

The ring 74 is provided with a dowel 75 intended to be inserted into one orifice 76 of a series of orifices 76 arranged in the movable counter-rack 31 plate (FIGS. 13 and 16). The orifices 76 are distributed along an arc of a circle in relation to the axis of rotation of the ring 74 and they are distributed so as to correspond to a clamping position of the movable counter-rack 31 plate.

The fitting of the assembly 30 as depicted in FIGS. 13 to 16, 17A and 17B is achieved in the following way.

First of all, at least one assembly 30 is placed at the level of the deck 1 and close to a chord 5 of a leg 2.

The movable counter-rack 31 plate is in an open position so that the width of the space 33 allows placing the teeth 34 of the counter-rack 31 plates onto the teeth 9 of the chord 5 of the corresponding leg 2.

Then, the two counter-rack 31 plates of an assembly 30 are fitted onto the racks 10 of the chord 5 in such a way that the teeth 34 of said counter-rack 31 plates engage with the teeth 9 of the racks 10. After the installation of said assembly 30, a device is fitted on the drive head 66 of the cam 62 of one of the main means of displacement 60 for rotationally driving said head 66 to rotate the corresponding cam 62 in order to displace the movable counter-rack 31 plate. Then, the same operation is carried out on the other said main means of displacement 60 in order to laterally displace said movable counter-rack 31 plate. According to another method, the cams 62 of the main means of displacement 60 may be driven simultaneously.

Figure 17B:
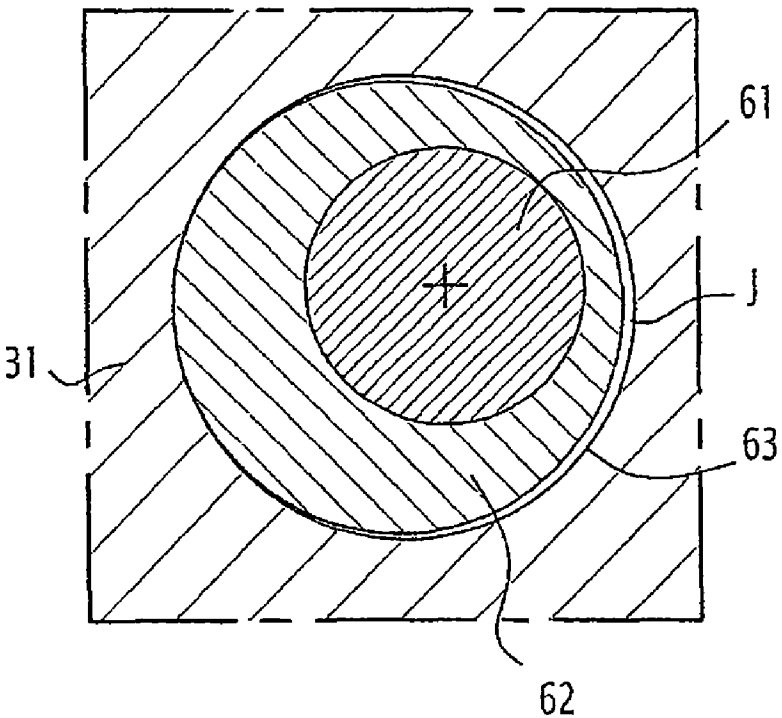
Figure 17A:
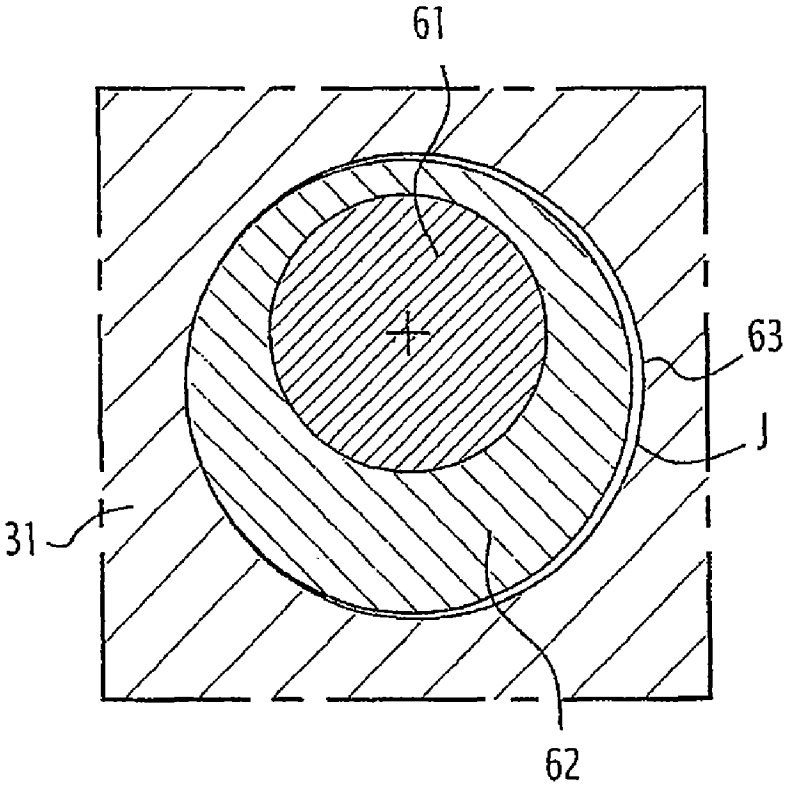

FIGS. 17A and 17B show the position of a cam 62 before its rotation (FIG. 17A) and after its rotation (FIG. 17B). Since there is no clearance, other than the functional clearance, between the cam 62 and the orifice 63 of the movable counter-rack 31 plate at the level of the lowest situated main means of displacement 60 and there is a clearance between the cam 62 and the orifice 63 at the level of the highest main means of displacement 60 on said counter-rack 31 plate, the movable counter-rack 31 plate is displaced laterally.

In the case of two main means of displacement 60 and two secondary means of displacement 60, one of the main means of displacement 60 comprises, between the cam 62 and the orifice 63, a larger clearance than the clearance between the cam 62 and the orifice 63 of the other main means of displacement 60, but smaller than the clearance of the secondary means of displacement 60.

Generally speaking, the secondary means of displacement 60 always have a larger clearance than the largest clearance of the main means of displacement 60.

Subsequently, the cams 62 of the secondary means of displacement 60 are rotationally driven for completing the clamping of the two counter-rack 31 plates onto the racks 10 of the chord 5 of the corresponding leg 2.

If necessary, after said clamping has been carried out, another complementary clamping is performed by rotationally driving the cams 62 of the main and/or secondary means of displacement 60.

During the rotation of each cam 62, the ring 74 of each means of displacement 60 is rotationally driven via the intermediary of the cogs 71 and 72 arranged respectively on the shoulder 67 of the cam 62 and in the orifice 73 of said ring 74. Each ring 74 is locked onto the movable counter-rack plate in the closed locking position of said movable counter-rack 31 plate by placing a dowel 75 in an orifice 76, as shown in FIG. 16.

Maintaining the movable counter-rack 31 plate in its closed position is completed by screwing members 80 which pass through said counter-rack 31 plate and which are screwed into the support sub-plates 35*a* of the support plate 35. Next, each assembly is wedged by appropriate means, not shown, on the platform deck 1.

In the case where the movable counter-rack 31 plate comprises a single means of displacement 60, it is sufficient to rotationally drive the cam 62 of said means of displacement to bring the corresponding counter-rack 31 plates into a clamping position.

The horizontal plates 49 arranged between each pair of stiffeners 41 and 46, in addition to said stiffeners 41 and 46, enable the hold of the assembly 30 onto the racks 10 to be improved. This is because the weight of the platform deck 1 creates what is termed by specialists a cogging thrust, which has a tendency to part the counter-rack 31 plates from the racks 10. This phenomenon is limited by the horizontal plates 49.

Without going outside the scope of the invention, several assemblies 30 may be fitted one above the other onto a rack 10 of a chord 5 of a leg 2. In all cases, the assembly or assemblies 30 are, after fitting onto a rack 10, wedged with respect to the deck 1 in such a way that the assemblies 30 partly support the deck 1 so as to relieve the pinions 22 of the drive mechanisms 20.

According to a variant, the two counter-rack plates may be movable.

The invention claimed is:

1. A complementary locking system configured and operable to lock legs to a deck of a jack-up drilling platform including a plurality of legs, the deck, and a drive mechanism for each leg and supported by the deck, the drive mechanism for each leg comprising at least two groups of opposing pinions supported by the deck, racks opposing the pinions, the racks being fitted onto the leg, and the racks are operable in cooperation with the pinions when the pinions are rotated for displacing the deck between a low position and an upraised, operating position, the complementary locking system being configured and operable to maintain the deck on the legs in the operating position, on each leg the complementary locking system including at least one locking assembly comprising:

two opposing counter-racks, each counter-rack comprising a plate having an internal end and an external end, the plate including teeth positioned at the internal end of the plate such that the teeth engage with a respective one of the racks;

at least one internal element positioned at the internal end of the plate of each counter-rack and configured to connect the internal ends of the counter-rack plates; and at least one external element positioned at the external end of the plate of each counter-rack and configured to connect the external ends of the counter-rack plates.

2. A system as claimed in claim 1, wherein the at least one internal element is comprised of a plurality of parallel stiffeners distributed over a height of the counter-rack plates, with a space between neighboring stiffeners of the plurality of stiffeners.

3. A system as claimed in claim 2, wherein each stiffener of the at least one internal element has a shape of a half-ellipse or has a curvilinear form.

4. A system as claimed in claim 1, wherein the at least one external element is comprised of a plurality of parallel stiffeners distributed over a height of the counter-rack plates, with a space between neighboring stiffeners of the plurality of stiffeners.

5. A system as claimed in claim 4, wherein each stiffener of the at least one external element includes a central portion and two curved lateral portions, each lateral portion connecting one end of the central portion to the external end of a respective counter-rack plate.

6. A system as claimed in claim 4, wherein each stiffener of the at least one external element includes:

a straight central portion having a longitudinal extent parallel to the plates of the counter-racks; and two straight lateral portions, each lateral portion connecting one end of the central portion to the external end of a respective counter-rack plate.

7. A system as claimed in claim 4, wherein each stiffener of the at least one external element comprises a central portion and two lateral portions, each lateral portion connecting one end of the central portion to the external end of one of a respective counter-rack plates;

a maintaining device configured and operable to maintain the plates of the counter-racks in a clamped position such that the teeth of the plates engage with the racks;

a housing positioned at a middle of the central portion and directed towards the internal element for positioning the maintaining device.

8. A system as claimed in claim 7, wherein the maintaining device for the counter-rack plates includes at least one wedge configured to be inserted into the housing and positioned in at least one stiffener of the at least one external element, the wedge having a complementary form to a portion of a form of the housing.

9. A system as claimed in claim 1, further comprising at least one intermediate member positioned and configured to connect the at least one internal element with the at least one external element.

10. A system as claimed in claim 1, further comprising a parting device configured and operable to part, via the at least one external element, the two counter-rack plates from one another before installation of the assembly on the racks of the corresponding leg.

11. A system as claimed in claim 10, wherein the parting device is further configured and operable to bring together, via the at least one external element, the two counter-rack plates to engage the racks for the installation of the assembly.

12. A system as claimed in claim 11, wherein the parting device includes at least two threaded rods with opposing pitches, each rod connected by one end of the rod to a threaded sleeve and by another end of the rod to at least one of the stiffeners of the at least one external element, such that a rotation of the sleeve displaces the rods in opposite directions.

13. A system as claimed claim 8, wherein the parting device for the counter-rack plates includes at least one heating source configured to apply heat to at least one of the stiffeners of the at least one internal element.

14. A system as claimed in claim 1, further comprising a controlling device configured and operable to bring together, via the at least one external element, the two counter-rack plates to engage the racks for installation of the assembly on the racks of the corresponding leg.

15. A system as claimed in claim 14, further comprising a device configured to maintain, via the at least one external element, the two counter-rack plates in a clamped position such that the teeth of the plates engage with the racks after the installation of the assembly.

16. A system as claimed in claim 14, wherein the controlling device includes:

at least one metal rod fixed at each end thereof to at least one stiffener of the at least one external element; and at least one heating source configured and operable to heat the metal rod.

17. A system as claimed in claim 1, further comprising:

a support plate positioned and configured to support the counter-rack plate such that the counter-rack plate is movable on the support plate; and a displacement device positioned and configured to displace the counter-rack plate on the support plate between an open mounting position of the assembly on the racks of the corresponding leg and a closed locking position of the counter-rack plates on the racks of the leg after installation of the assembly.

18. A system as claimed in claim 17, further comprising at least one lock configured to lock in the closed position the counter-rack plate on the support plate.

19. A system as claimed in claim 18, wherein the support plate includes an inside face facing the internal element and the external element and an outside face facing away from the inside face, and the counter-rack plate has an orifice having an inner wall, wherein each displacement device includes:

a cylindrical pin having a longitudinal extent perpendicular to the inside face of the support plate; and a cam fitted on the cylindrical pin, the cam positioned in the orifice in the counter-rack plate such that a central axis of the cam is offset in relation to a central axis of the pin, the cam comprising a shoulder; and the lock for the counter-rack plate comprises:

a first cog positioned on the periphery of the shoulder of the cam;

a ring having an orifice positioned in the ring, the ring comprising a dowel;

a second cog cooperating with the first cog and positioned in the orifice of the ring such that the ring is rotationally displaceable during the rotation of the cam, and the ring is positioned and configured to be locked onto the counter-rack plate by the dowel in the closed position of the counter-rack plate.

20. A system as claimed in claim 17, wherein the support plate is comprised of a plurality of independent support sub-plates with a space between neighboring sub-plates, each support sub-plate positioned and configured to connect a stiffener of the internal element and a stiffener of the external element.

21. A system as claimed in claim 17, wherein the displacement device comprises a plurality of displacement units, each displacement unit positioned at a level of a respective one of the support sub-plates.

22. A system as claimed in claim 17, wherein the support plate includes an inside face facing the internal element and the external element and an outside face facing away from the inside face, and the counter-rack plate has an orifice having an inner wall, wherein each displacement device includes:

a cylindrical pin having a longitudinal extent perpendicular to the inside face of the support plate; and a cam fitted on the cylindrical pin, the cam positioned in the orifice in the counter-rack plate such that a central axis of the cam is offset in relation to a central axis of the pin.

23. A system as claimed in claim 22, wherein the cam is positioned in the orifice spaced from the inner wall of the orifice.

24. A system as claimed in claim 22, wherein the cam comprises one end jutting out with respect to the counter-rack plate and the one end including a member positioned and configured to rotationally drive the cam.

25. A system as claimed in claim 22, wherein the cam comprises a shoulder positioned and configured to maintain the counter-rack plate against the support plate.

26. A method of installing a complementary locking system as claimed in claim 1, the method comprising the following steps:

placing at the level of the deck and close to each leg at least one of the locking assemblies;

parting, via the at least one external element, the two counter-racks from one another;

fitting the two counter-racks onto racks of the corresponding leg;

allowing the counter-racks to take up an initial position at the racks so that the counter-racks maintain the assembly on the corresponding leg; and wedging each assembly on the deck.

27. A method as claimed in claim 26, further comprising:

after fitting the two counter-racks onto respective racks of the corresponding leg, bringing the two counter-racks together for clamping onto the racks; and maintaining the counter-racks in this clamping position, before the wedging of each assembly on the deck.

28. A method of installing a locking system as claimed in claim 19, the method comprising the following steps:

placing at the level of the deck close to each leg at least one of the locking assemblies such that the at least one counter-rack plate is in the open position;

fitting the two counter-rack plates onto the respective racks of the corresponding leg;

rotationally driving the cam of the displacement device to bring the corresponding counter-rack plate into the closed locking position and to clamp the two counter-rack plates onto the racks on the legs;

locking the ring on the counter-rack plate; and wedging each assembly on the platform deck.

29. A method as claimed in claim 28, further comprising before locking the ring, complementary clamping the counter-rack plate by rotationally driving the cam of the displacement device.

30. A method of installing a locking system as claimed in claim 19, the method comprising the following steps:

placing at the level of the deck close to each leg at least one of the locking assemblies such that the counter-rack plates are in the open position;

fitting the two counter-rack plates in the open position onto the racks of the corresponding leg;

rotationally driving the cams of the displacement device for clamping the two counter-rack plates onto the racks;

rotationally driving the cams of a secondary displacement device for completing the clamping of the two counter-rack plates onto the racks;

locking the rings on the movable counter-rack plate; and wedging each assembly on the platform deck.

31. A method as claimed in claim 30, further comprising before locking the rings, performing another complementary clamping of the movable counter-rack plate by rotationally driving the cams of at least one of main and secondary displacement devices.

32. In combination, a complementary locking system and a jack-up drilling platform comprising:

the locking assembly according to claim 1;

the jack-up drilling platform comprising;

a plurality of legs configured to be anchored to a sea floor;

a deck configured to be movably secured to the plurality of legs;

and a drive mechanism for each leg comprising:

at least two groups of opposing pinions supported by the deck; and racks opposing the pinions and positioned on the legs, the racks being configured and operable in cooperation with the pinions to move the deck between a low position and an upraised, operating position.

* * * * *